US012637248B2

(12) United States Patent
López Masagué

(10) Patent No.: US 12,637,248 B2
(45) Date of Patent: May 26, 2026

(54) SHIPPING BOX

(71) Applicant: Embalajes Capsa, S.L., Canet de Mar (ES)

(72) Inventor: Manuel López Masagué, Canet de Mar (ES)

(73) Assignee: Embalajes Capsa, S.L., Canet de Mar (ES)

( * ) Notice: Subject to any disclaimer, the term of this patent is extended or adjusted under 35 U.S.C. 154(b) by 0 days.

(21) Appl. No.: 17/069,427

(22) Filed: Oct. 13, 2020

(65) Prior Publication Data

US 2021/0024244 A1 Jan. 28, 2021

Related U.S. Application Data

(63) Continuation of application No. PCT/EP2019/060761, filed on Apr. 26, 2019.

(30) Foreign Application Priority Data

Apr. 26, 2018 (EP) ..... 18382281

(51) Int. Cl.
*B65D 5/02* (2006.01)
*B65D 5/10* (2006.01)
*B65D 5/54* (2006.01)

(52) U.S. Cl.
CPC ..... *B65D 5/0227* (2013.01); *B65D 5/10* (2013.01); *B65D 5/541* (2013.01)

(58) Field of Classification Search
CPC ..... B65D 5/0227; B65D 5/10; B65D 5/541; B65D 5/6602; B65D 5/6605
(Continued)

(56) References Cited

U.S. PATENT DOCUMENTS 9,714,112 B1 * 7/2017 Lin ..... B65D 77/36
2003/0201315 A1 * 10/2003 Jamison ..... B65D 5/541 229/102

(Continued)

FOREIGN PATENT DOCUMENTS

DE 202012003954 U1 9/2013
DE 102012007800 A1 * 10/2013 ..... B65D 5/0227

(Continued)

OTHER PUBLICATIONS

Machine Translation of DE-202013009905-U1 (Year: 2013).*
Search Report in corresponding International Patent Application No. PCT/EP2019/060761, mailed Jun. 19, 2019.

*Primary Examiner* — Nathan J Newhouse
(74) *Attorney, Agent, or Firm* — Edell, Shapiro & Finnan, LLC

(57) ABSTRACT

A shipping box comprises a sheet of corrugated material defining a plurality of channels parallel to one another. The sheet comprises a lid, a base, and four side walls. The lid includes first and second inner flaps and at least one outer flap. The first and second inner flaps are engageable to each other by themselves. The at least one outer flap includes: a projecting portion that projects with respect to the first and second inner flaps in a unfolded position of the sheet, at least one sealing element arranged on the projecting portion to seal the shipping box, and at least one tear strip arranged on the projecting portion to open the shipping box. The length of the at least one outer flap is greater than the lengths of the first and second inner flaps.

18 Claims, 10 Drawing Sheets

(58) Field of Classification Search
USPC ..... 229/132, 136, 143, 212, 141, 154
See application file for complete search history.

(56) References Cited

U.S. PATENT DOCUMENTS

| | | | | |
|---|---|---|---|---|
| 2011/0056975 | A1* | 3/2011 | Mcgillion | B65D 5/6602 220/810 |
| 2013/0186804 | A1* | 7/2013 | Miller | B65D 5/4204 206/772 |
| 2014/0197230 | A1* | 7/2014 | Lopez Masague | B65D 5/4608 229/123.2 |
| 2016/0137335 | A1* | 5/2016 | Mora | B65D 5/546 53/412 |
| 2018/0118405 | A1* | 5/2018 | Walling | B65D 5/443 |

FOREIGN PATENT DOCUMENTS

| | | | | |
|---|---|---|---|---|
| DE | 202013009905 | U1 * | 2/2014 | B65D 5/0227 |
| DE | 202016004802 | U1 * | 9/2016 | |
| EP | 2527264 | A1 | 11/2012 | |
| EP | 2724953 | A1 * | 4/2014 | B65D 5/0227 |
| EP | 3453634 | A1 | 3/2019 | |
| GB | 1072288 | A * | 6/1967 | B65D 5/103 |
| KR | 101752371 | B1 | 7/2017 | |
| WO | 2008139420 | A1 | 11/2008 | |
| WO | 2012160543 | A1 | 11/2012 | |

* cited by examiner

SHIPPING BOX

CROSS REFERENCE TO RELATED APPLICATIONS

This application is a continuation of International Application No. PCT/EP/2019/060761, filed on Apr. 26, 2019, which claims priority under 35 U.S.C. § 119 to Application No. EP 18382281.6 filed on Apr. 26, 2018, the entire contents of which are hereby incorporated by reference.

TECHNICAL FIELD

The present invention relates to a shipping box which easily allows for the opening of the box after a first shipment and for the sealing thereof at least a second time.

BACKGROUND

Boxes used for shipping and/or the storage of objects are known. These boxes are normally made of cardboard and comprise a hinged lid. The lid is normally made up of four flaps, two upper flaps and two lower flaps.

These boxes, which are already known, are made up of a sheet provided with a number of folding lines, such that by an assembly process the box can be obtained and ready for use.

For stackable storage boxes and shipping boxes, it is normal to use corrugated cardboard for the reinforcement thereof.

Examples of boxes formed from a sheet and provided with a hinged lid are described in WO2008139420A1 and WO2012160543A1, which are by the same applicant as that of the present application.

WO2008139420A1 describes a box for storage and transport, the lid of which comprises inner flaps and outer flaps, the outer flaps being engageable to each other.

The box described in this document comprises a base made up of four sections joined together which allow the base to automatically fold and unfold when folding or unfolding the box.

On the other hand, WO2012160543A1 describes a storage, transport and shipping box comprising a first pair of flaps, the ends of which are substantially in contact with one another, or overlapped to each other, and a second pair of flaps engageable to each other. Based on the use thereof, the first flaps and the second flaps can be used as inner flaps. Thus, if the box is used for storage, the first flaps are the inner flaps and the box is closed by engaging the second flaps, and if the box is used for shipping, the engageable second flaps are the inner flaps, and the box is closed using an additional closing element, such as an adhesive tape on the first flaps.

This document also describes the use of a tear strip on the first flaps, which allows the box to be easily opened.

Thus, one object of the present invention is to provide a shipping box that allows the box to be easily opened after a first shipment and sealed at least a second time, for example when returning a shipped item, and which can also be reused.

SUMMARY

The shipping box of the invention solves the drawbacks mentioned, and introduces other advantages described below.

The shipping box according to the present invention is formed from a sheet of corrugated material, the corrugated material defining a plurality of channels parallel to one another, the box comprising:

- a lid, which comprises two inner flaps and at least one outer flap, the inner flaps engageable to each other by themselves, i.e., with no external element, and the at least one outer flap comprising at least one sealing element for sealing the box and at least one tear strip for opening the box;
- a base; and
- four side walls;
- and wherein the length of the at least one outer flap is greater than the length of the inner flaps, defining a projecting portion on the at least one outer flap which projects with respect to the inner flaps in the unfolded position of the sheet that forms the box, such that the at least one sealing element and the at least one tear strip are arranged on the projecting portion.

According to alternative embodiments, the box comprises two outer flaps, which are completely or partially overlapping one another, or the box comprises a single outer flap, the outer flap comprising a folding line, such that in the sealed position thereof, the at least one sealing element and the at least one tear strip are placed on one of the side walls.

Advantageously, the at least one sealing element is arranged between the at least one tear strip and a distal end of the at least one outer flap.

According to different embodiments, the at least one outer flap comprises two sealing elements and a tear strip placed between both sealing elements, or the at least one outer flap comprises two sealing elements or two tear strips.

In the shipping box according to the present invention, the at least one outer flap can comprise at least one additional flap also provided with the at least one sealing element, also arranged on the projecting portion.

Moreover, the at least one outer flap can comprise two additional flaps.

Advantageously, the additional flap or flaps laterally project with respect to the at least one outer flap.

If so desired, the additional flap or flaps may comprise two sealing elements and a tear strip.

Advantageously, the additional flap or flaps are joined to the at least one outer flap by at least one folding line or perforated line in order to facilitate the folding and opening of the box.

Preferably, the sealing element is self-adhesive glue with a protective paper or double-sided tape, and the tear strip is a perforated strip or a tape. The use of tape makes it so it is not necessary to perforate, and this way the resistance of the flap is not compromised.

Advantageously, the tear strip comprises a tab on one of the ends thereof.

Preferably, the channels of the corrugated material are perpendicular or inclined with respect to a folding line that joins the at least one outer flap to one of the side walls.

According to a preferred embodiment, the box has a rectangular cross section defining a rectangle with larger and smaller sides, and the outer flaps are the flaps that are hinged to the smaller sides of the rectangle. However, the box can also have a square cross section, so that all the sides have the same length and the outer flaps are hinged to two sides with a same length of the square.

The shipping box according to the present invention has at least the following advantages:

- It allows the box to be sealed at least a second time after a first shipment, for example, for a making a return, since the at least outer flap will be able to be sealed by a second sealing element of the box itself or by an external sealing element, such as adhesive tape;

In the case of comprising two outer flaps, the same continue to overlap one another after a first opening of the box by the tear strip, allowing for at least a second sealing of the box;

It facilitates the manufacturing of the box, since the projection of the projecting portion facilitates the placement of the sealing element after the folding and/or gluing of the box during or after the manufacturing thereof, without the need to lift any flap that could be preventing access to the area where the sealing elements and/or tear strips are placed;

It allows for a reinforced sealing and a reinforced structure, thanks to the inner flaps that are engageable to each other, even after a first shipment;

The inner flaps, which are engageable, permit to provide a reinforcing surface for facilitating the external flaps to be sealed by the sealing element;

It allows the box to be sealed without any external sealing elements;

At no point does the sealing element make contact with the inner flaps, which are always intact, for example to be able to use the box as a storage;

It prevents access to the inside of the box by the inner flaps that are engageable to each other because the inner flaps occupy the whole surface of the opening of the box;

It facilitates the recycling thereof, since it does not require the use of an outer plastic adhesive tape;

The additional flaps allow the lid to be sealed to the side walls, making the box more tamper-proof, and the inner flaps allow the additional flaps to be better fastened by providing more resistance and preventing the side walls from moving towards the inside.

It allows the box to be temporarily closed before being sealed, for example when preparing delayed shipments;

The vertical channel of the cardboard in the position of use thereof provides greater resistance for the adhesion of the self-adhering strip when pressure is exerted for sealing.

BRIEF DESCRIPTION OF THE DRAWINGS

For the purpose of helping to make the foregoing description more readily understandable, it is accompanied by a set of drawings which, schematically and by way of illustration and not limitation represent several embodiments of the present invention.

DETAILED DESCRIPTION

Figure 1:
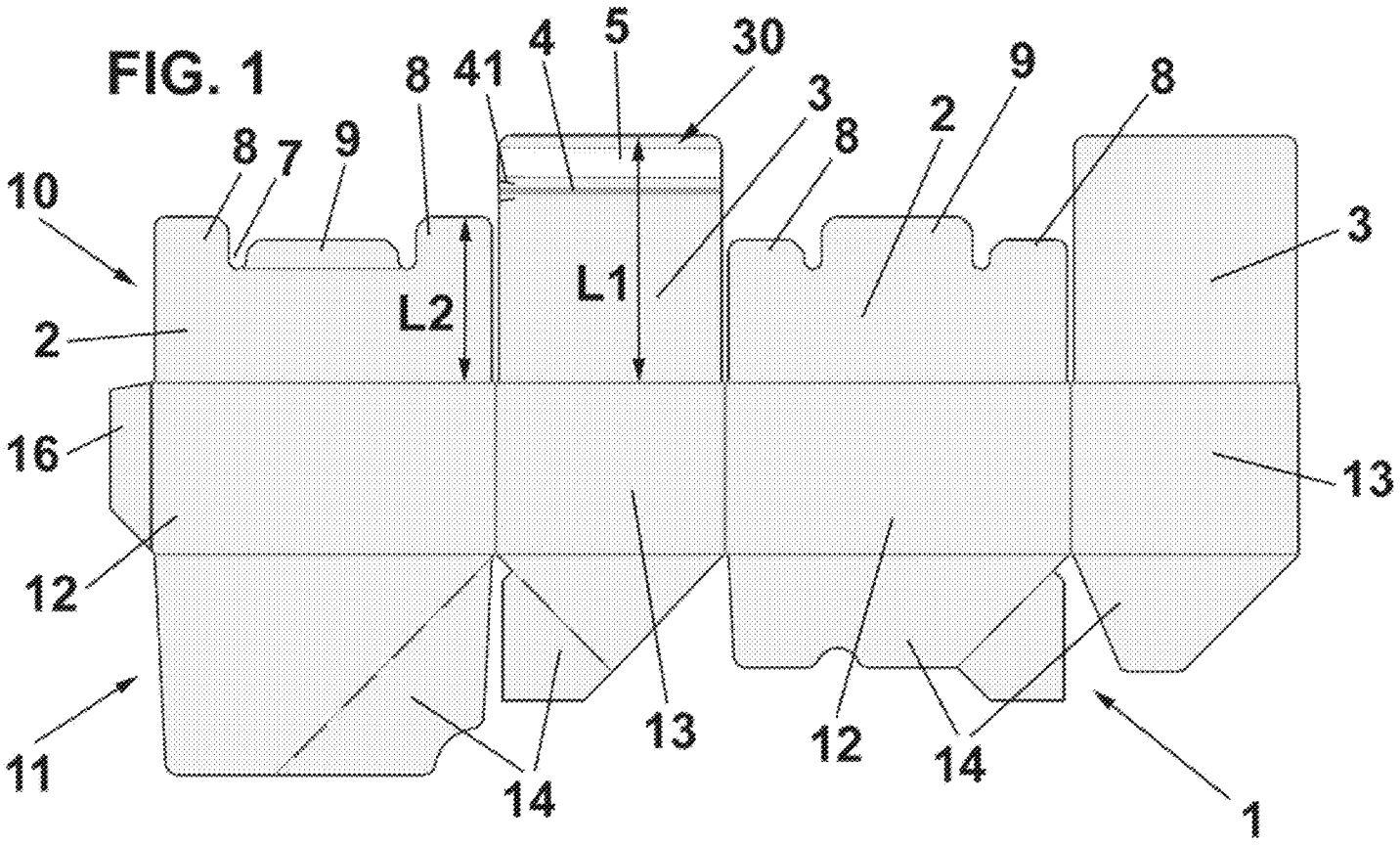
FIG. 1 is a plan view of the sheet that forms the shipping box in accordance with the present invention, according to a first embodiment.

Firstly, it must be indicated that the shipping box according to the present invention is formed from a single sheet of corrugated material, preferably corrugated cardboard, which defines a plurality of channels substantially parallel to one another.

The box of the present invention can be used for sending products, in other words, it requires characteristic of resistance to prevent the products from being damaged during the use of the box, which is also stackable.

A first embodiment of the box according to the present invention is shown in FIGS. 1 to 4.

According to this first embodiment, the box is formed from a sheet 1 of corrugated cardboard, which, in the assembled position thereof, defines a lid 10, a base 11, and four side walls 12, 13.

The lid 10 is formed by two pairs of flaps, inner flaps 2 and outer flaps 3, which extend in an articulated way from the opposite side walls 12, 13, respectively.

In the unfolded position of the sheet forming the box, these inner flaps 2 and outer flaps 3 are independent from each other, i.e., they are not connected to each other.

In the case that the box has a rectangular cross section defining a rectangle with larger sides and smaller sides, the outer flaps 3 are preferably the ones that are hinged to the smaller sides of the rectangle. Therefore, less material is used because these outer flaps 3 needs a greater length for placing the sealing element 5 and the tear strip 4.

However, the box can also have a square cross section, so that all the sides have the same length and the outer flaps 3 are hinged to two sides with a same length of the square.

In turn, according to the embodiment shown, the base 11 is also made up of four flaps 14, which form a base that is automatically assembled when assembling the box. However, it must be indicated that the base 11 could have any configuration.

The flaps 14 that form the base 11 will not be described in greater detail, since they are conventional and are described, for example, in document WO2008139420A1.

According to the embodiment shown, the inner flaps 2 of the lid 10 are engageable to each other by themselves, i.e., with no additional element, interlocking the inner flaps 2 effectively closing the box. In other words, the inner flaps 2 comprise at least a slot 7 that defines at least two tabs 8, 9, which in the assembled position thereof are overlapped to each other. In order to facilitate the engagement, to make it more robust with regard to compression, and at the same time more stable in a closed position, one of the tabs 8, 9 can be longer than the other, as can be seen in the figures. The longitudinal axis of the tabs 8, 9 is preferably perpendicular to the channels of the corrugated cardboard that forms the inner flaps 2.

To be able to engage the inner flaps 2 of the lid, the folding lines that separate the lid 10 from the side walls 12, 13 could be aligned with one another.

The orientation of the channels of corrugated material is vertical in the side walls 12, 13 in the position of use thereof, or the channels can be diagonally inclined. Moreover, the box is formed from a single sheet, which implies that the channels of corrugated material in the inner flaps 2 of the lid 10 are substantially perpendicular with respect to the channels of corrugated material in the outer flaps 3 of the lid 10, thereby reinforcing them.

In this embodiment, one of the outer flaps 3 comprises a tear strip 4 and a sealing element 5. The tear strip 4 can be a perforated strip or tape, and the sealing element 5 can be a self-adhesive glue with a protective paper which prevents accidental use before the use thereof, or double sided tape. Furthermore, the tear strip 4 comprises a tab 41 on one of the ends thereof, in order to facilitate the opening of the box by the tear strip 4.

As can be seen in FIGS. 1 to 4, the sealing element 5 is arranged between the tear strip 4 and the distal end of the outer flap 3, with respect to the side wall 13 to which it is hinged.

As can be seen in FIG. 1, the length L1 of the outer flaps 3 is greater than the length L2 of the inner flaps 2, defining a projecting portion 30 on the outer flaps 3 which project with respect to the inner flaps 2 in the unfolded position of the sheet that forms the box, shown in the FIG. 1. In other words, the projecting portion 30 has a length that is equal to L1-L2, the sealing element 5 and the tear strip 4 being arranged on the projecting portion 30.

It must be stated that it is not necessary that both outer flaps 3 have a length L1 greater than the length L2 of the inner flaps 2, but rather only the outer flap 3 which has the sealing element 5 and the tear strip 4 must have a greater length than the length L2 of the inner flaps.

This characteristic facilitates the manufacturing of the box, by being able to place the sealing element 5 and the tear strip 4 during the manufacturing process with a fastening tab 16 joined to the opposite side wall 13, since the length L2 of the inner flaps 2 does not interfere with the projecting portion 30 of the outer flap 3 where the tear strip 4 and the sealing element 5 are placed.

The assembly process of the box in accordance with the present invention is described below.

Firstly, in the manufacturing factory of the box, the fastening tab 16 is glued and joined to the opposite side wall 13 thereof. In this configuration, the box in the unassembled position is completely flat, such that it occupies a reduced space for the transportation thereof before it is filled with products. It is in this moment when the tear strip 4 and the fastening element 5 can be placed.

Figure 2:
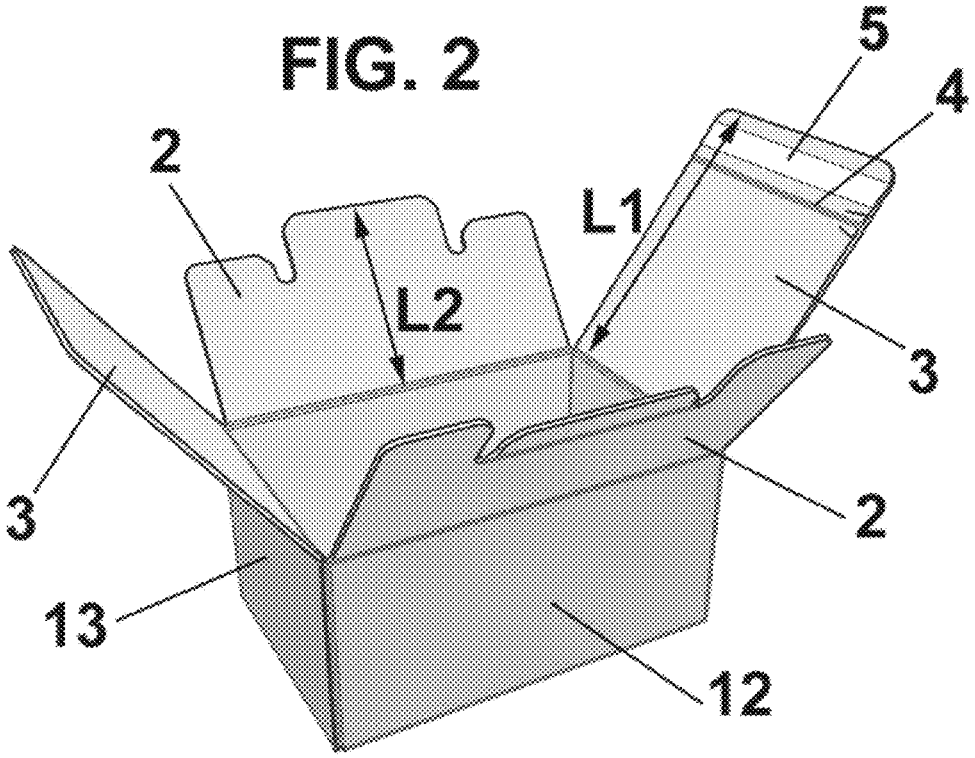
FIG. 2 is a perspective view of the box in accordance with the first embodiment, in the assembled position thereof with the lid open.
Figure 3:
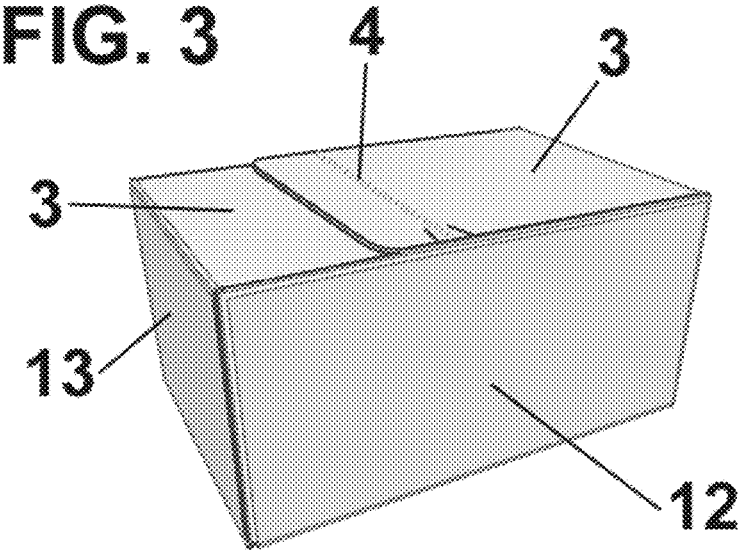
FIG. 3 is a perspective view of the box in accordance with the first embodiment, in the assembled position thereof with the lid closed.

When one wants to use the box, the same is placed in the position shown in FIG. 2, with the lid 10 thereof open. According to the embodiment shown, the base 11 will be automatically assembled, as is known in the art.

Figure 4:
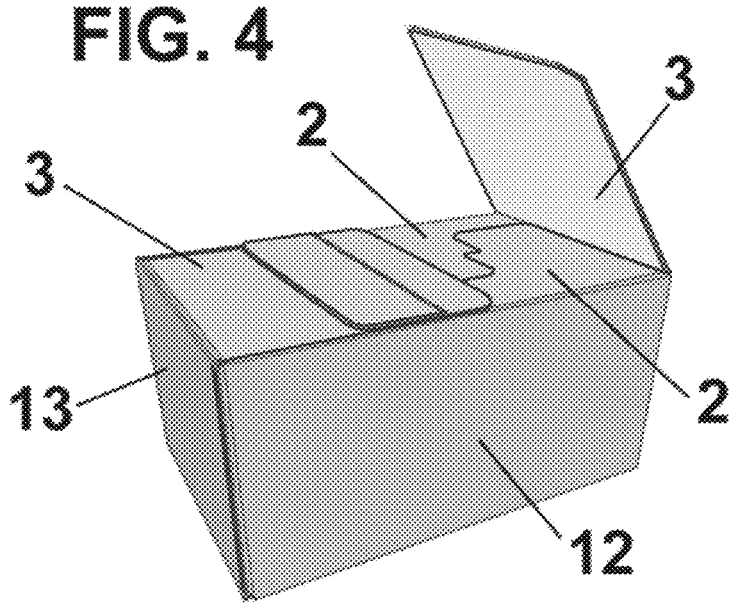
FIG. 4 is a perspective view of the box in accordance with the first embodiment, in the assembled position thereof with the lid open after a first use.

To seal the lid 10, first the inner flaps 2 that are engageable to each other, and then the outer flaps 3, are folded towards the inside of the box. For the shipping thereof, the lid 10 is closed, fixing the sealing element 5 to the other outer flap 3. As can be seen in FIG. 4, the outer flaps 3 are partially overlapped, although they could also be completely overlapped.

During the folding of the inner flaps 2, they are engaged to each other by slots 7, the tabs 8, 9 remaining overlapped to each other. It must be stated that the tabs 8, 9 have dimensions that are suitable for the inner flaps 2 to be remain closed without the need to use an additional sealing element.

It must be observed that the sealing element 5 only fastens one outer flap 3 over the other outer flap 3, the inner flaps 2 remaining intact. Moreover, given that the inner flaps 2 are engageable to each other, unauthorized access to the inside of the box is prevented.

To open the box, one pulls the tear strip 4 by using the tab 41, such that a portion of the outer flap 3 is separated from the rest, allowing the opening of the box, as shown in FIG. 4. To access the inside of the box, one needs simply disengage the inner flaps 2.

As can be seen in FIG. 4, if so desired, the box according to the present invention can be used a second time, since the outer flaps 3 are still partially overlapped with respect to each other after a first opening of the box. As a result, using an adhesive strip, one can seal the box by the outer flaps 3. Furthermore, the inner flaps 2 engageable to each other allow the box to be used as a storage box without using any type of additional sealing elements.

Figure 5:
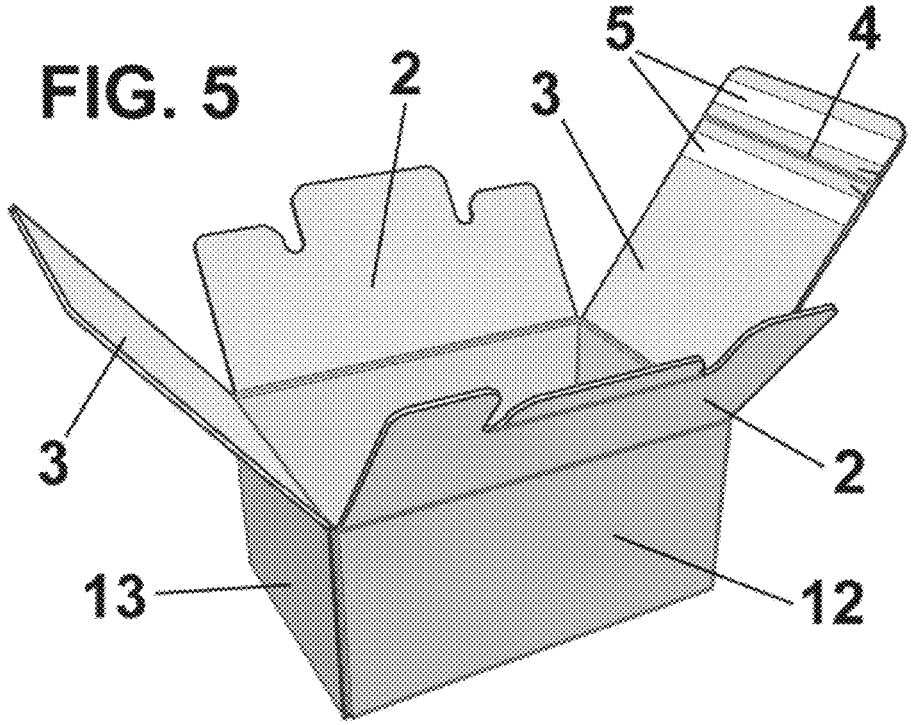
FIG. 5 is a perspective view of the box in accordance with a second embodiment, in the assembled position thereof with the lid open.
Figure 6:
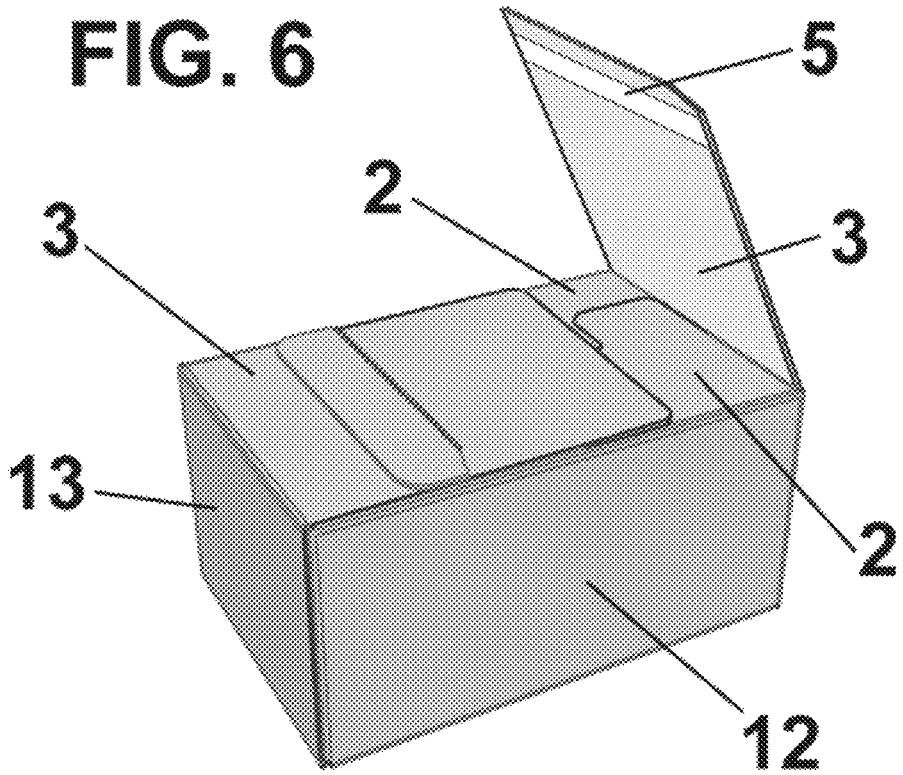
FIG. 6 is a perspective view of the box in accordance with the second embodiment, in the assembled position thereof with the lid open after a first use.
Figure 7:
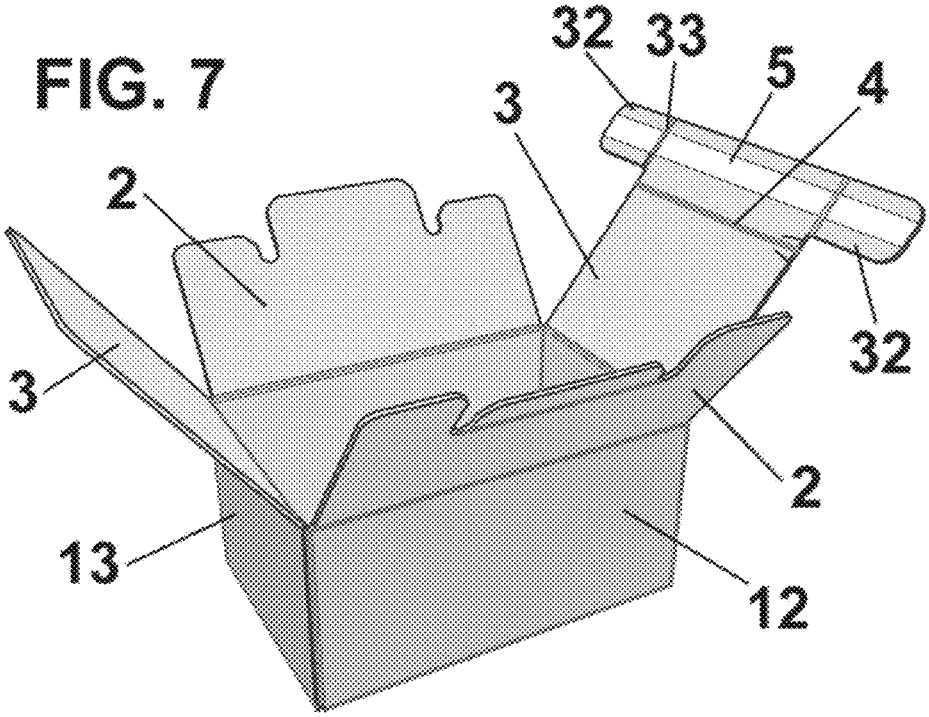
FIG. 7 is a perspective view of the box in accordance with a third embodiment, in the assembled position thereof with the lid open.

FIGS. 5 to 6 show another embodiment of the box according to the present invention.

For reasons of simplicity and clarity, the same reference numbers are used to identify the same components of the box in this embodiment. Moreover, only the differences with respect to the aforementioned first embodiment are described, so as to simplify.

In the embodiment shown in FIGS. 5 and 6, the difference with respect to the first embodiment is the presence of two sealing elements 5 on one of the outer flaps 3, the tear strip 4 being arranged between the two sealing elements 5.

In this embodiment, the process of assembling, sealing and opening the box is the same as in the previously described process. The difference is that when the box has been opened for the first time, the box can be sealed again without the need to use an external sealing element, but rather the second sealing element 5 can be used, as shown in FIG. 6. This second sealing element 5 can be used, for example, to make a return using the same box.

FIGS. 7 to 10 show another embodiment of the box according to the present invention.

For reasons of simplicity and clarity, the same reference numbers are used to identify the same components of the box in this embodiment. Moreover, only the differences with respect to the aforementioned first embodiment are described, so as to simplify.

In this embodiment, an outer flap 3 comprises at least one additional flap 32, in this case two additional flaps 32, provided with the sealing element 5, and the additional flaps 32 also being arranged on the projecting portion 30. These additional flaps 32 laterally project with respect to the outer flap 3.

Figure 8:
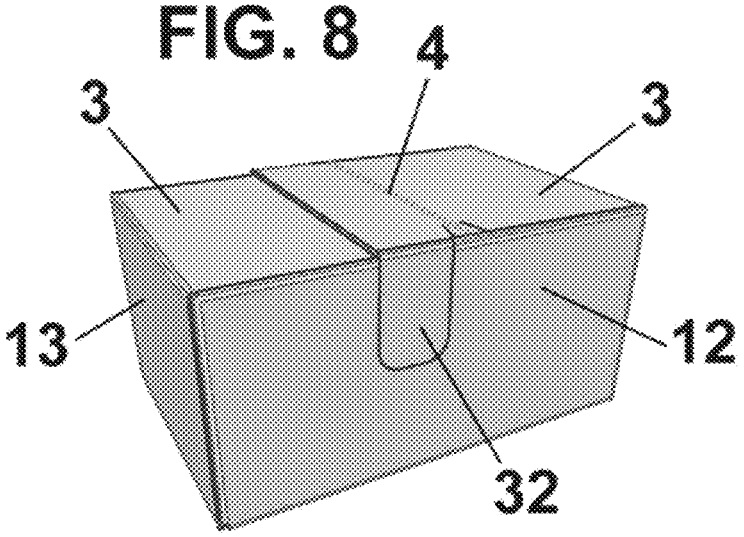
FIG. 8 is a perspective view of the box in accordance with the third embodiment, in the assembled position thereof with the lid closed.
Figure 9:
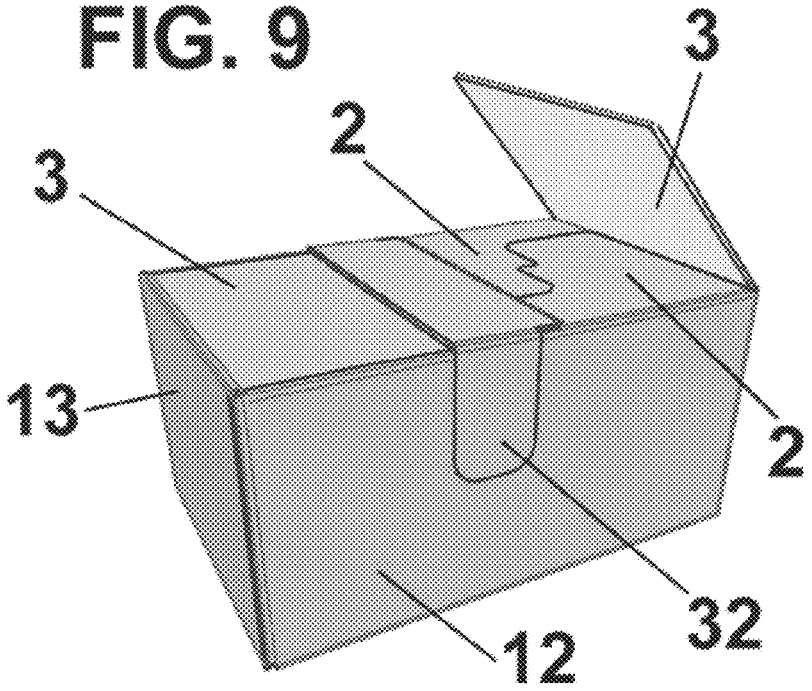
FIG. 9 is a perspective view of the box in accordance with the third embodiment in the opening process thereof.

In the closed position of the box, shown in FIG. 8, the additional flaps 32 are fastened to two side walls 12 of the box, the rest of the sealing of the box being the same as previously described.

Figure 10:
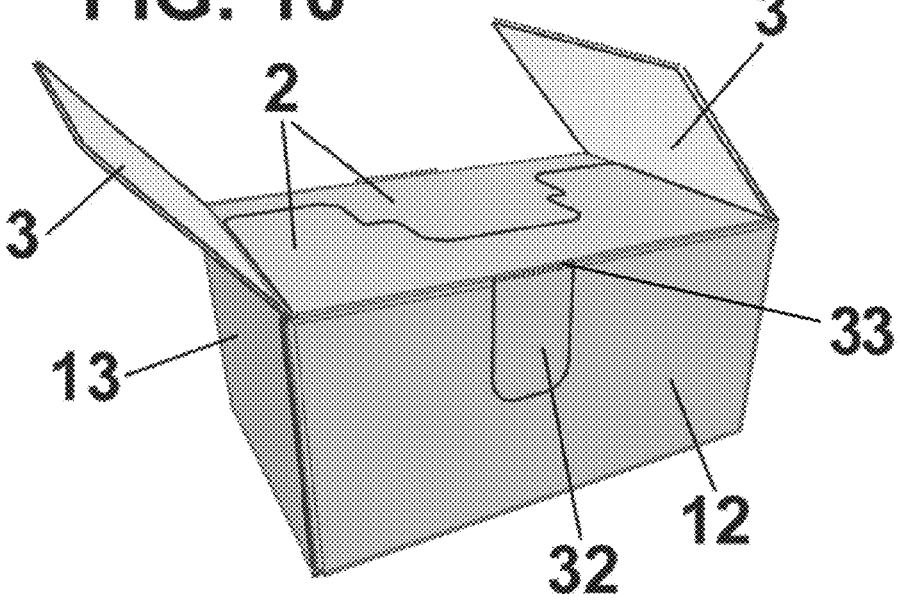
FIG. 10 is a perspective view of the box in accordance with the third embodiment, in the assembled position thereof with the lid open after a first use.

To open the box, one first pulls the tear strip 4, as in the previously described embodiment (FIG. 9), and then pulls the other outer flap 3, separating it, keeping the additional flaps 32 fastened to the side walls 12 (FIG. 10). To facilitate the separation of the additional flaps 32 from the outer flap 3, the joining is done by a perforated folding line 33.

To access the inside of the box, one needs simply disengage the inner flaps 2.

If one wants to seal the box again, in this embodiment one can do so using adhesive tape, since the outer flaps 3 have the distal ends thereof facing each other or substantially in contact.

As was previously stated, the additional flaps 32 allow the lid 10 to be sealed to the side walls 12, 13, making the box more tamper-proof.

FIGS. 11 to 14 show another embodiment of the box according to the present invention.

For reasons of simplicity and clarity, the same reference numbers are used to identify the same components of the box in this embodiment. Moreover, only the differences with respect to the aforementioned first embodiment are described, so as to simplify.

Figure 11:
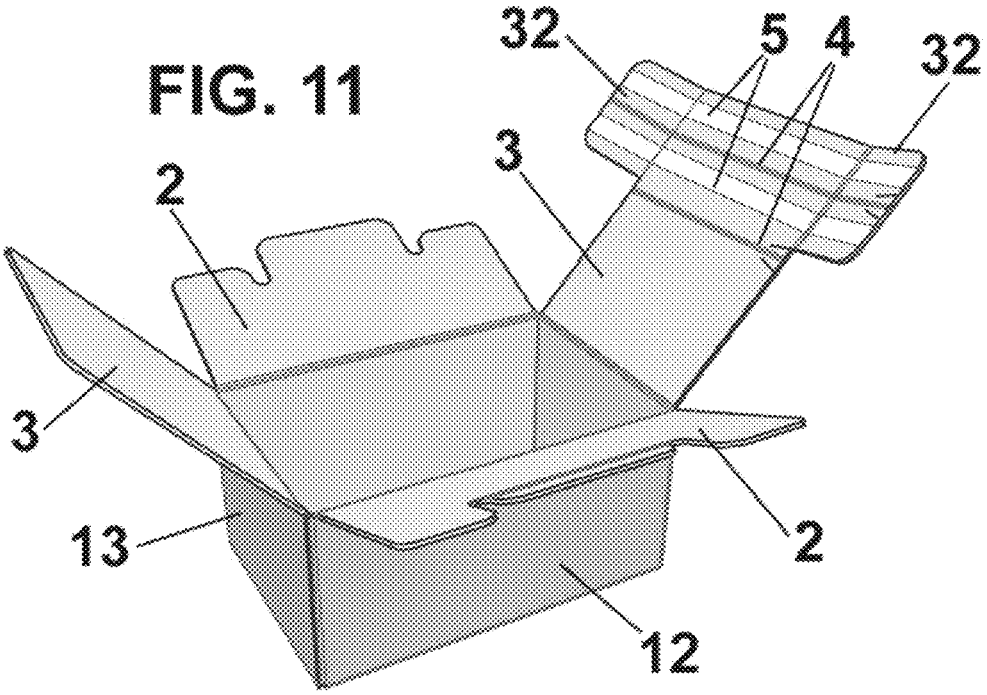
FIG. 11 is a perspective view of the box in accordance with a fourth embodiment, in the assembled position thereof with the lid open.
Figure 12:
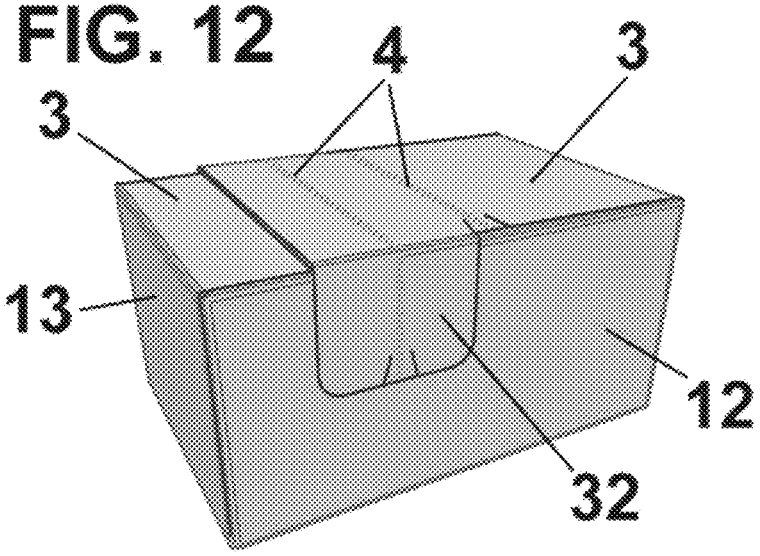
FIG. 12 is a perspective view of the box in accordance with the fourth embodiment, in the assembled position thereof with the lid closed.
Figure 13:
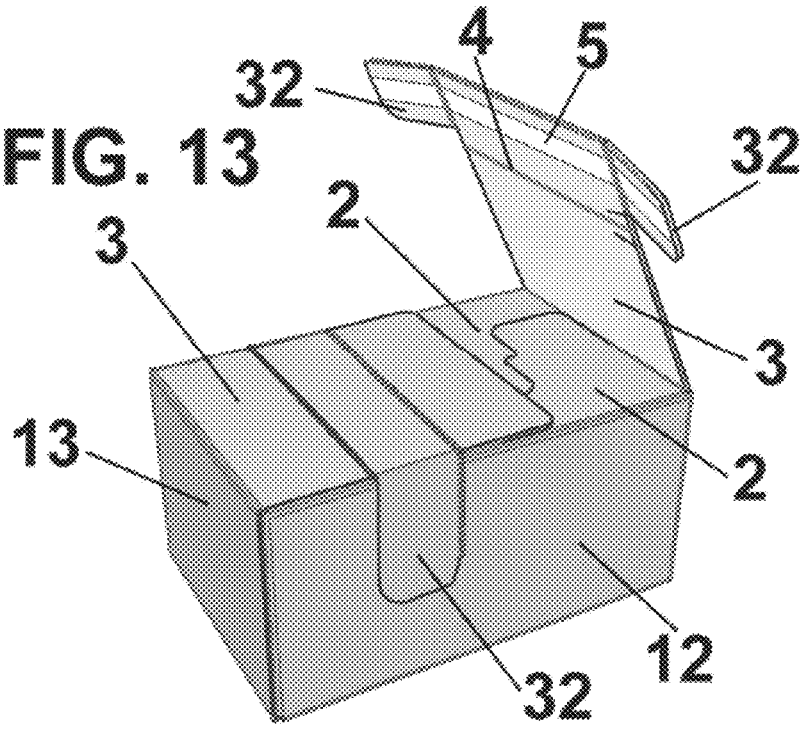
FIG. 13 is a perspective view of the box in accordance with the fourth embodiment in the opening process thereof.
Figure 14:
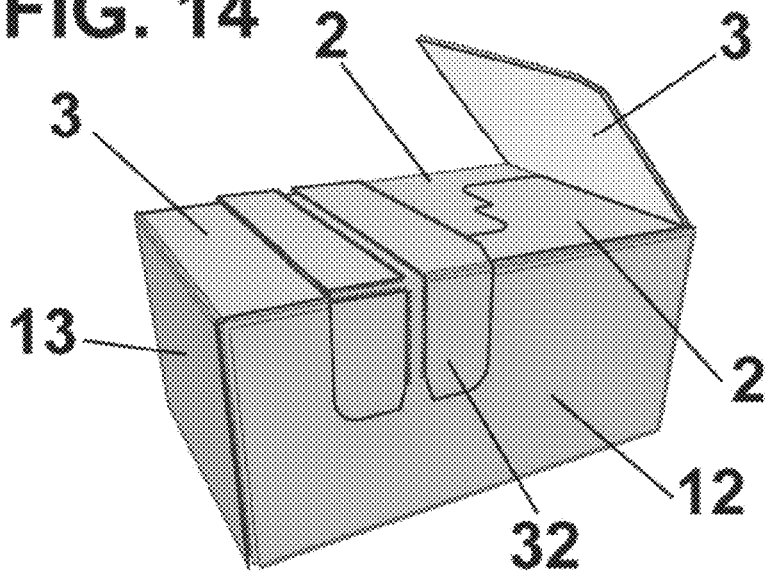
FIG. 14 is a perspective view of the box in accordance with the fourth embodiment, in the assembled position thereof with the lid open after a first use.

With respect to the previous embodiment, the difference is that an outer flap 3 and the two additional flaps 32 comprise two sealing elements 5 and two tear strips 4, the sealing elements 5 and tear strips 4 being alternatively arranged, with the first sealing element closer to the distal end of the outer flap 3. As can be seen in FIG. 11, the second tear strip 4 does not extend on the additional flaps 32.

The sealing and opening process of this embodiment of the box is the same as that of the previous embodiment. Once the box is opened for the first time (FIG. 13) it may be sealed again and opened again using the second sealing element 5 and the second tear strip 4.

Once the box is opened a second time (FIG. 14) if one wants to seal the box again, one can do so using adhesive tape, since the outer flaps 3 have the distal ends thereof facing each other or substantially in contact.

Figure 15:
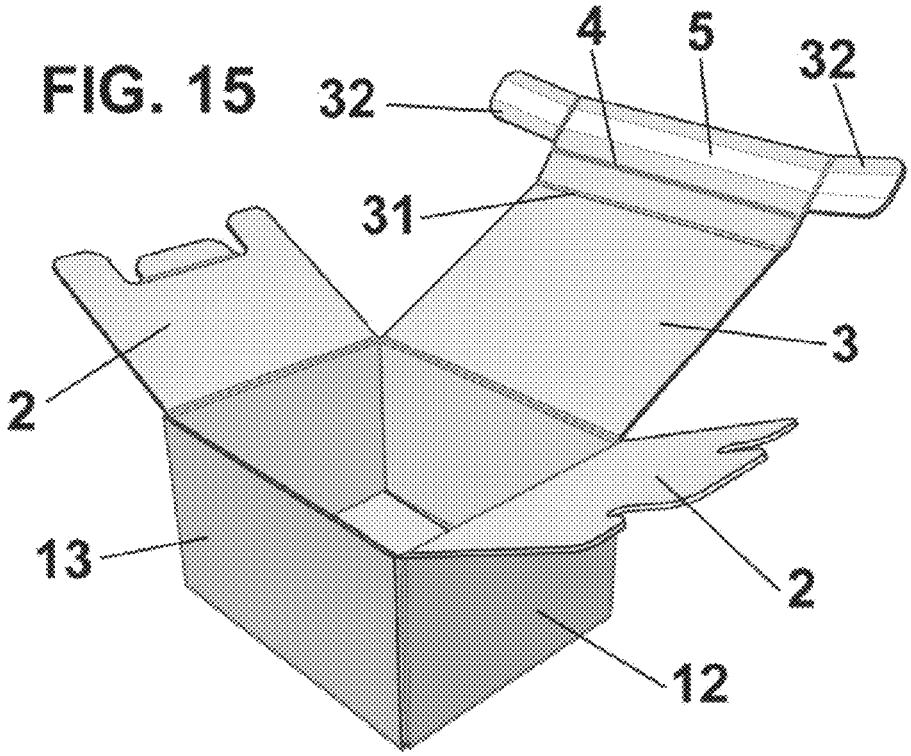
FIG. 15 is a perspective view of the box in accordance with a fifth embodiment, in the assembled position thereof with the lid open.
Figure 16:
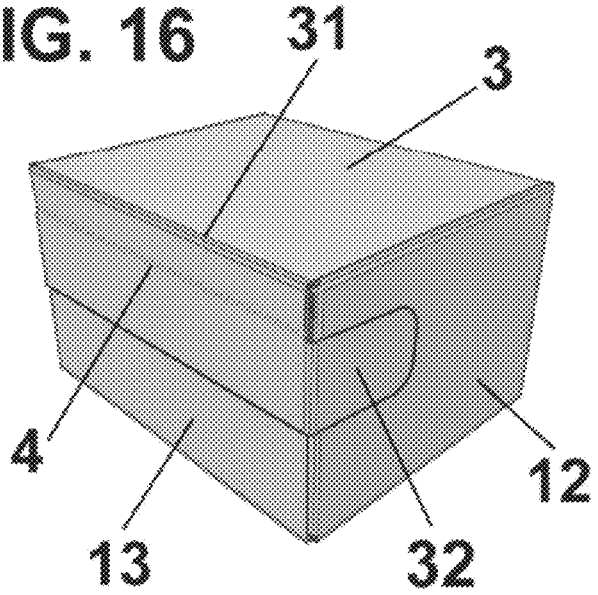
FIG. 16 is a perspective view of the box in accordance with the fifth embodiment, in the assembled position thereof with the lid closed.
Figure 17:
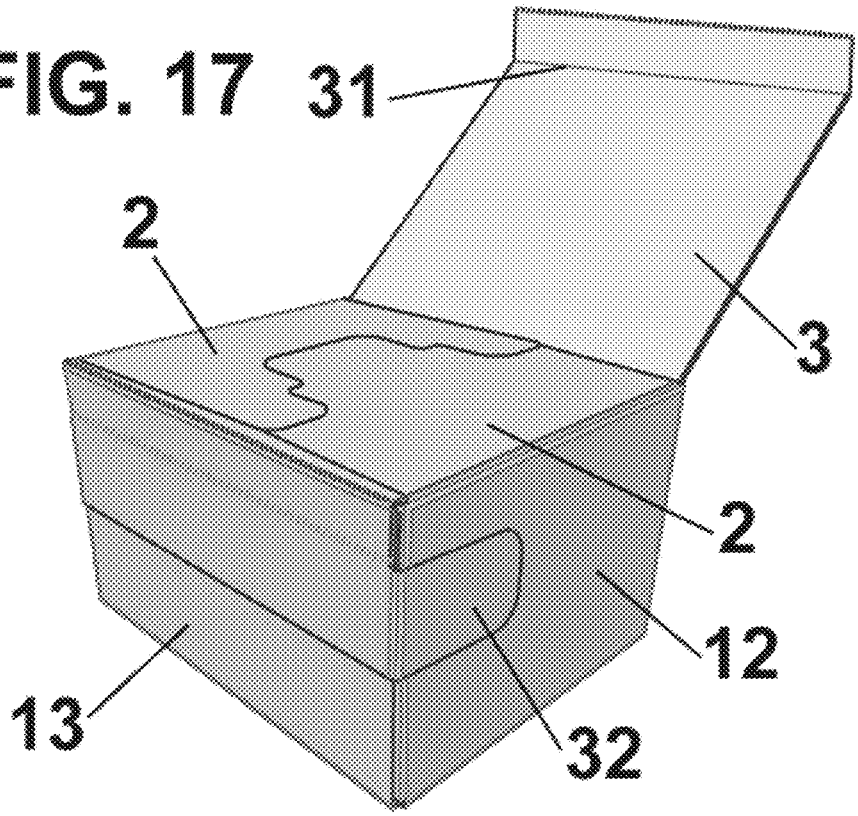
FIG. 17 is a perspective view of the box in accordance with the fifth embodiment, in the assembled position thereof with the lid open after a first use.

FIGS. 15 to 17 show another embodiment of the box according to the present invention.

For reasons of simplicity and clarity, the same reference numbers are used to identify the same components of the box in this embodiment. Moreover, only the differences with respect to the aforementioned first embodiment are described, so as to simplify.

In this embodiment, the box comprises a single outer flap 3, provided with a folding line 31, and the sealing element 5 is fixed to a side wall 13 and not to another outer flap 3.

In this embodiment the box further comprises two additional flaps 32, which in the sealed position are fixed to another two side walls 12, as shown in FIG. 16.

To open the box, one pulls the tear strip 4 and the outer flap 3 is separated into two, allowing the box to be opened. To access the inside of the box, one needs simply disengage the inner flaps 2.

Also in this embodiment, to seal the box again, one can use additional adhesive tape.

Despite the fact that reference has been made to several specific embodiments of the invention, it is evident for the person skilled in the art that numerous variations and changes may be made to the shipping and transport box described, that all the aforementioned details may be substituted by other technically equivalent ones, and that the characteristics described in different embodiments can be combined, without detracting from the scope of protection defined by the attached claims.

What is claimed is:

1. A shipping box comprising:

a sheet of corrugated material defining a plurality of channels parallel to one another, the sheet comprising:
- a lid;
- a base; and
- four side walls, wherein the lid includes:
- first and second inner flaps, each having a length and extending outward from one side wall, and
- at least one outer flap having a length greater than the lengths of the first and second inner flaps and extending outward from another side wall, wherein the first and second inner flaps include flap engagement structure configured to overlap and interlock with each other by themselves in an assembled position of the box, wherein the at least one outer flap includes:
- a projecting portion that projects with respect to the first and second inner flaps in an unfolded position of the sheet,
- at least one sealing element arranged on the projecting portion to seal the shipping box, and
- at least one tear strip arranged on the projecting portion to open the shipping box, wherein the projecting portion of the at least one outer flap projects outward past the flap engagement structure of the first and second inner flaps in its entirety, wherein the at least one sealing element and the at least one tear strip are arranged on the projecting portion such that they project outward past the flap engagement structure of the first and second inner flaps in their entirety, wherein the projecting portion is configured to project in its entirety past the flap engagement structure of the first and second inner flaps such that placement of the at least one sealing element and the at least one tear strip on the at least one outer flap is facilitated after folding of the box during or after its manufacture due to a lack of interference from the first and second inner flaps, and wherein the flap engagement structure comprises at least one slot which, in the assembled position of the box, enables the inner flaps to interlock with each other, thereby providing a reinforcing surface which makes the box more robust to compression and facilitates sealing of the at least one outer flap by the at least one sealing element.

2. The shipping box of claim 1, wherein the shipping box comprises two outer flaps that are completely or partially overlapped with each other.

3. The shipping box of claim 1, wherein the shipping box comprises a single outer flap comprising a folding line, such that in the sealed position thereof, the at least one sealing element and the at least one tear strip are placed on one of the side walls.

4. The shipping box of claim 1, wherein the at least one sealing element is arranged between the at least one tear strip and a distal end of the at least one outer flap.

5. The shipping box of claim 1, wherein the at least one outer flap comprises two sealing elements and a tear strip placed between both sealing elements.

6. The shipping box of claim 1, wherein the at least one outer flap comprises two sealing elements and two tear strips.

7. The shipping box of claim 1, wherein the sealing element is self-adhesive glue with a protective paper or double-sided tape.

8. The shipping box of claim 1, wherein the tear strip is a perforated strip or a tape.

9. The shipping box of claim 1, wherein the tear strip comprises a tab on one of the ends thereof.

10. The shipping box of claim 1, wherein the channels of the corrugated material are perpendicular or inclined with respect to a folding line that joins the at least one outer flap to one of the side walls.

11. The shipping box of claim 1, wherein the shipping box has a rectangular cross section defining a rectangle with larger and smaller sides, and the at least one outer flap is hinged to a smaller side of the rectangle.

12. A shipping box comprising:

a sheet of corrugated material defining a plurality of channels parallel to one another, the sheet comprising:
a lid;
a base; and
four side walls, wherein the lid includes:
first and second inner flaps, each having a length and extending outward from one side wall, and
at least one outer flap having a length greater than the lengths of the first and second inner flaps and extending outward from another side wall, wherein the first and second inner flaps include flap engagement structure configured to overlap and interlock with each other by themselves in an assembled position of the box, wherein the at least one outer flap includes:
a projecting portion that projects with respect to the first and second inner flaps in an unfolded position of the sheet,
at least one sealing element arranged on the projecting portion to seal the shipping box, and
at least one tear strip arranged on the projecting portion to open the shipping box, wherein the projecting portion of the at least one outer flap projects outward past the flap engagement structure of the first and second inner flaps in its entirety, wherein the at least one sealing element and the at least one tear strip are arranged on the projecting portion such that they project outward past the flap engagement structure of the first and second inner flaps in their entirety, wherein the projecting portion is configured to project in its entirety past the flap engagement structure of the first and second inner flaps such that placement of the at least one sealing element and the at least one tear strip on the at least one outer flap is facilitated after folding of the box during or after its manufacture due to a lack of interference from the first and second inner flaps, wherein the flap engagement structure comprises at least one slot which, in the assembled position of the box, enables the inner flaps to interlock with each other, thereby providing a reinforcing surface which makes the box more robust to compression and facilitates sealing of the at least one outer flap by the at least one sealing element, and wherein the at least one outer flap comprises at least one additional flap also provided with the at least one sealing element also arranged on the projecting portion.

13. The shipping box of claim 12, wherein the at least one additional flap comprises two additional flaps.

14. The shipping box of claim 13, wherein the additional flaps laterally project with respect to the at least one outer flap.

15. The shipping box of claim 13, wherein the additional flaps comprise two sealing elements and a tear strip.

16. The shipping box of claim 13, wherein the additional flaps are joined to the at least one outer flap by at least one perforated folding line.

17. A shipping box comprising:

a sheet of corrugated material defining a plurality of channels parallel to one another, the sheet comprising:
a lid;
a base; and
four side walls, wherein the lid includes first and second inner flaps each having a length and at least one outer flap having a length greater than the lengths of the first and second inner flaps, wherein the first and second inner flaps include flap engagement structure that are engageable to each other in an interlocking manner in an assembled position of the box, wherein the at least one outer flap comprises:
a projecting portion that projects in its entirety past the first and second inner flaps in an unfolded position of the sheet,
at least one sealing element arranged on the projecting portion to seal the shipping box,
at least one tear strip arranged on the projecting portion to open the shipping box, and
at least one additional flap laterally projecting in its entirety from the projecting portion of the at least one outer flap, wherein the at least one additional flap includes at least one sealing element to seal the shipping box.

18. The shipping box of claim 17, wherein the at least one outer flap further comprises a second additional flap laterally projecting in its entirety from the projecting portion of the at least one outer flap, the second additional flap including at least one sealing element to seal the shipping box.

* * * * *